US007953350B2

(12) United States Patent
Matsumoto et al.

(10) Patent No.: US 7,953,350 B2
(45) Date of Patent: May 31, 2011

(54) DEVELOPING DEVICE FOR DEVELOPING LATENT IMAGES TO TONER IMAGES

(75) Inventors: Junichi Matsumoto, Kanagawa (JP); Natsumi Katoh, Kanagawa (JP); Nobuo Iwata, Kanagawa (JP); Tomoyuki Ichikawa, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 390 days.

(21) Appl. No.: 11/613,969

(22) Filed: Dec. 20, 2006

(65) Prior Publication Data

US 2007/0154242 A1 Jul. 5, 2007

(30) Foreign Application Priority Data

Dec. 20, 2005 (JP) ..... 2005-366835
Oct. 6, 2006 (JP) ..... 2006-275089

(51) Int. Cl.
*G03G 15/08* (2006.01)

(52) U.S. Cl. ..... 399/254; 399/53; 399/258

(58) Field of Classification Search ..... 399/58, 399/254, 255, 258, 256, 257, 260
See application file for complete search history.

(56) References Cited

U.S. PATENT DOCUMENTS 5,591,506 A 1/1997 Miller et al.
5,652,947 A * 7/1997 Izumizaki ..... 399/58
5,682,583 A * 10/1997 Ito et al. ..... 399/254
5,797,074 A 8/1998 Kasahara et al.
6,393,241 B1 5/2002 Matsumoto et al.
6,526,246 B2 2/2003 Iwata et al.
6,542,707 B2 4/2003 Muramatsu et al.
6,567,637 B2 5/2003 Yanagisawa et al.
6,571,076 B2 5/2003 Kasahara et al.
6,597,883 B2 7/2003 Muramatsu et al.
6,628,908 B2 9/2003 Matsumoto et al.
6,628,913 B2 9/2003 Matsumoto et al.
6,628,915 B2 9/2003 Muramatsu et al.
6,785,496 B2 8/2004 Iwata et al.
6,826,381 B2 11/2004 Muramatsu et al.
6,882,812 B2 4/2005 Kasahara et al.
6,898,405 B2 5/2005 Matsumoto et al.
7,043,179 B2 5/2006 Matsumoto et al.
7,065,313 B2 6/2006 Matsumoto et al.
7,076,191 B2 7/2006 Muramatsu et al.
7,085,522 B2 8/2006 Muramatsu et al.
7,116,928 B2 10/2006 Muramatsu et al.

(Continued)

FOREIGN PATENT DOCUMENTS

JP 04-198966 7/1992

(Continued)

OTHER PUBLICATIONS

U.S. Appl. No. 12/256,998, filed Oct. 23, 2008, Iwata et al.

(Continued)

*Primary Examiner* — David P Porta
*Assistant Examiner* — Benjamin Schmitt
(74) *Attorney, Agent, or Firm* — Oblon, Spivak, McClelland, Maier & Neustadt, L.L.P.

(57) ABSTRACT

A developing device including a development part for developing latent images to toner images. The developing device also includes an agitation part that agitates developer, and a controller, which controls an agitation strength of an agitator in the agitation part. The developer circulates between the development part and the agitation part.

13 Claims, 12 Drawing Sheets

U.S. PATENT DOCUMENTS

| | | | | |
|---|---|---|---|---|
| 7,127,198 | B2 | 10/2006 | Muramatsu et al. | |
| 7,130,558 | B2 | 10/2006 | Matsumoto et al. | |
| 7,221,891 | B2 | 5/2007 | Matsumoto et al. | |
| 7,245,853 | B2 | 7/2007 | Muramatsu et al. | |
| 7,277,664 | B2 | 10/2007 | Katsuyama et al. | |
| 7,450,891 | B2 | 11/2008 | Muramatsu et al. | |
| 7,542,703 | B2 | 6/2009 | Kasahara et al. | |
| 2003/0156859 | A1* | 8/2003 | Tamai | 399/254 |

FOREIGN PATENT DOCUMENTS

| | | |
|---|---|---|
| JP | 5-21082 | 5/1993 |
| JP | 7-225515 | 8/1995 |
| JP | 8-54816 | 2/1996 |
| JP | 2538763 | 7/1996 |
| JP | 8-248763 | 9/1996 |
| JP | 10-10853 | 1/1998 |
| JP | 10-20653 | 1/1998 |
| JP | 10-142942 | 5/1998 |
| JP | 10-239964 | 9/1998 |
| JP | 11-65245 | 3/1999 |
| JP | 2939099 | 6/1999 |
| JP | 11-231626 | 8/1999 |
| JP | 2981812 | 9/1999 |
| JP | 3069006 | 5/2000 |
| JP | 3734096 | 10/2005 |
| JP | 3734097 | 10/2005 |

OTHER PUBLICATIONS

U.S. Appl. No. 12/048,705, filed Mar. 14, 2008, Iwata, et al.
U.S. Appl. No. 12/126,441, filed May 23, 2008, Matsumoto, et al.
U.S. Appl. No. 12/129,961, filed May 30, 2008, Katoh, et al.
U.S. Appl. No. 12/130,092, filed May 30, 2008, Ohmura, et al.
U.S. Appl. No. 12/178,986, filed Jul. 24, 2008, Matsumoto, et al.

* cited by examiner

DEVELOPING DEVICE FOR DEVELOPING LATENT IMAGES TO TONER IMAGES

CROSS REFERENCE OF RELATED APPLICATIONS

This application claims foreign priority of Japanese patent application Nos. 2005-366835 and 2006-275089 whose entire disclosures are incorporated herein by reference.

FIELD OF THE INVENTION

This invention relates to a developing device for developing latent images to toner images with developer, which includes toner particles and carrier particles. The developing device is used in an image forming apparatus such as a copying machine, printer, fax machine or the like.

DESCRIPTION OF THE RELATED ART

A developing device that develops latent images on a latent image carrier, such as a photoconductor, to toner images has been used in an image forming apparatuses such as a copier, a printer or a fax. Some developing devices use two-component developer as the developer. Two-component developer includes toner particles and carrier particles.

As toner particles are consumed for development processes, new toner particles are replenished. Newly replenished toner particles are conveyed with carrier particles to a developer bearing member. In a developing device using two-component developer, it is desirable that toner particles spread sufficiently in the developer and acquire sufficient electric charge before reaching the developer bearing member. Otherwise, toner particles may scatter from the developing device or adhere to non-image part of latent images.

In a high-speed image forming apparatus, it is more difficult to charge toner particles properly because of the high conveying speed of the developer. Increasing an inner volume of the developing device is effective to accelerate the dispersion of toner particles in the developer, but leads to the undesirable effect of increasing the size of the image forming apparatus.

To improve this problem, the following systems have been proposed.

Japanese Utility Model Patent Publication No. 5-21082 describes an image forming apparatus in which an agitator is disposed in a photoconductor and the developer agitated by the agitator is sent back to the developer container through a pipe.

Japanese Laid-Open Patent Publication No. 4-198966 describes an image forming apparatus in which a developer agitator is separated from the developing device and connected to each other through a developer circulating means.

The systems mentioned above have a developer agitator separate from the developing device. Thus, the developer can be conveyed in a longer distance, resulting in more opportunity for the toner particles to make contact with carrier particles before arriving at the developer bearing member. Therefore, toner particles are agitated more efficiently with carrier particles and the number of insufficiently charged toner particles decreases.

However, in these systems, toner particles and carrier particles are easily worn out because of stress due to continuous agitation. For example, additive agents on the surface of toner particles tend to be left out or are forced into toner particles, and the electric chargeability or the fluidity of toner particles suffers. As for carrier particles, a coating layer on the surface of carrier particles may be scraped off because of the stress of the continuous agitation. Further, the electric chargeability of carrier particles may decline because additive agents or binder resin of toner particles tend to adhere to carrier particles.

SUMMARY OF THE INVENTION

Accordingly, an object of the present invention is to agitate the developer efficiently and control the electric charging quantity of toner particles.

BRIEF DESCRIPTION OF THE DRAWINGS

The invention is best understood from the following detailed description when read in conjunction with the accompanying drawings.

FIG. 9A shows a mesh image and FIG. 9B shows a stripe image having the same image area proportion as the image shown in FIG. 9A.

DETAILED DESCRIPTION

An exemplary embodiment of the present invention is explained in detail below with reference to the accompanying drawings. This exemplary embodiment is a preferred embodiment and the present invention is not restricted to the details of this embodiment.

Figure 1:
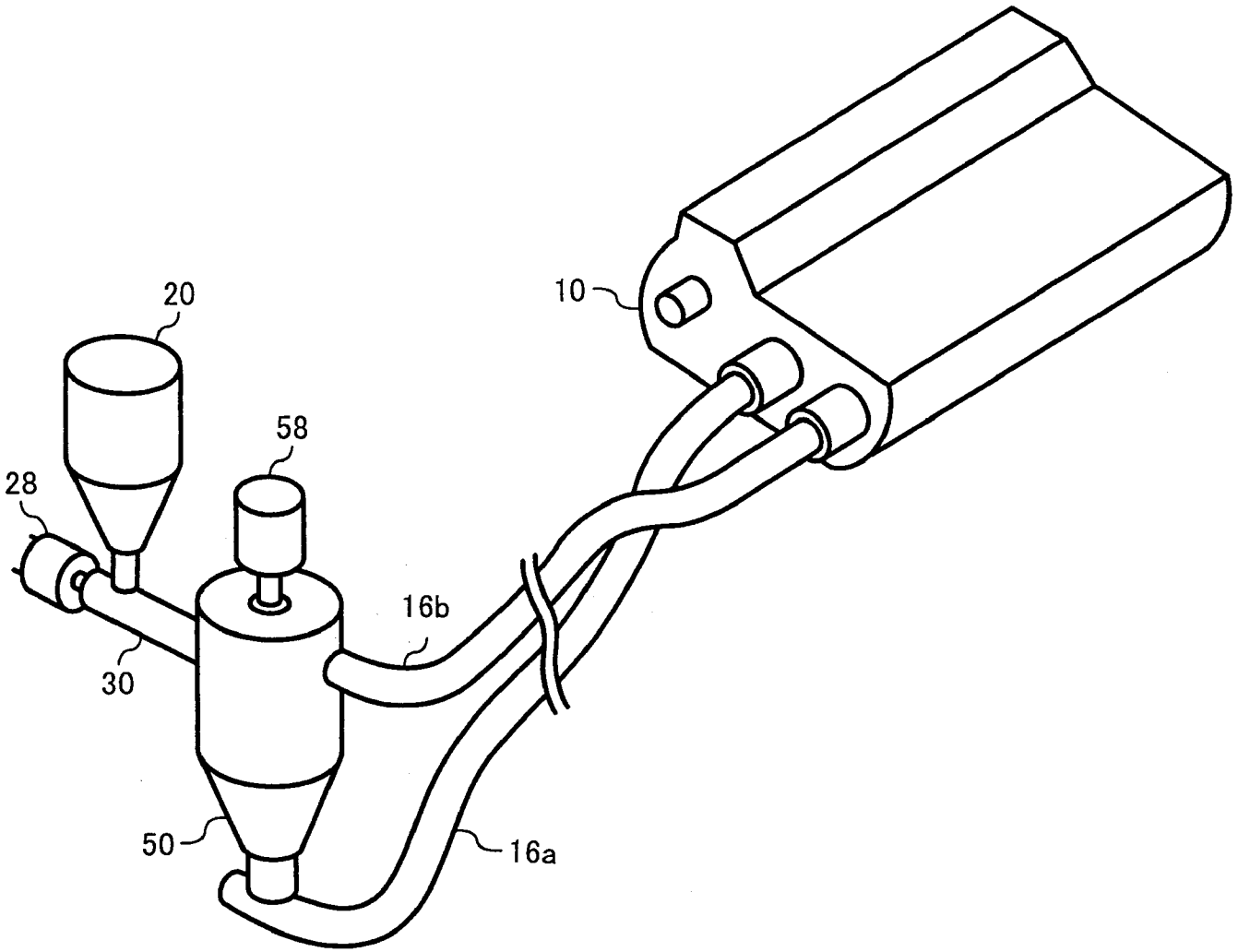
FIG. 1 is an oblique perspective figure of a developing device of an embodiment.
Figure 2:
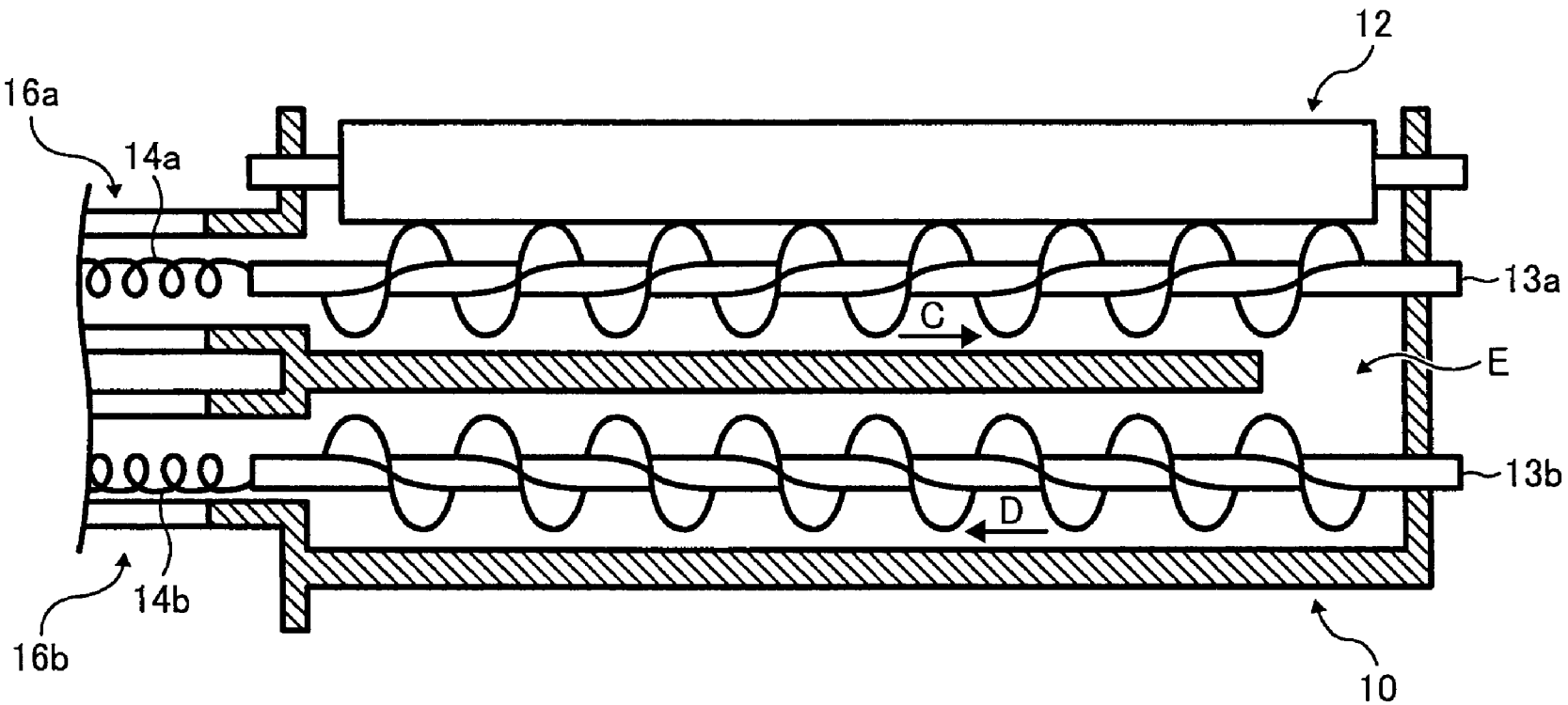
FIG. 2 is a longitudinal sectional view of a development part of an embodiment.
Figure 3:
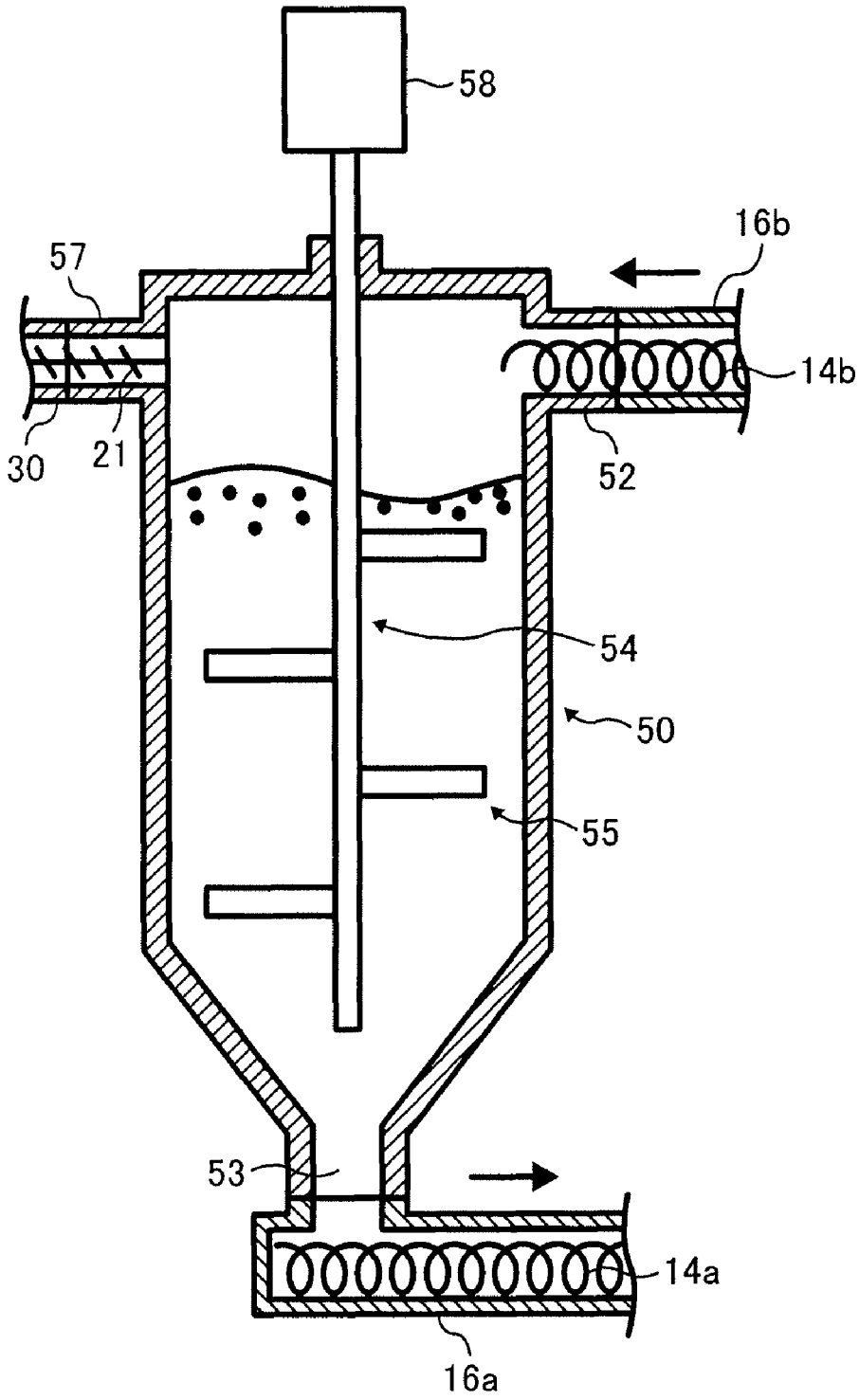
FIG. 3 is a longitudinal sectional view of an agitation part of an embodiment.

An embodiment of the present invention will be shown with accompanying drawings. FIG. 1 shows a developing device, FIG. 2 shows a cross section of a development part of the developing device shown in FIG. 1, and FIG. 3 shows a cross section of an agitation part used in the developing device shown in FIG. 1.

The developing device of this embodiment includes a development part 10, a toner container 20 and an agitation part 50. The development part 10 develops latent images to toner images, and the agitation part 50 agitates toner particles together with carrier particles. The toner container 20 is made from metal and/or synthetic resin, but may be constructed from any other suitable material.

In an image forming apparatus using an electrophotography process, a latent image on a latent image carrier is developed to a toner image by the developing device, and the toner image is transferred onto a recording medium. The toner image is then fixed to the recording medium by a fixing device.

Figure 14:
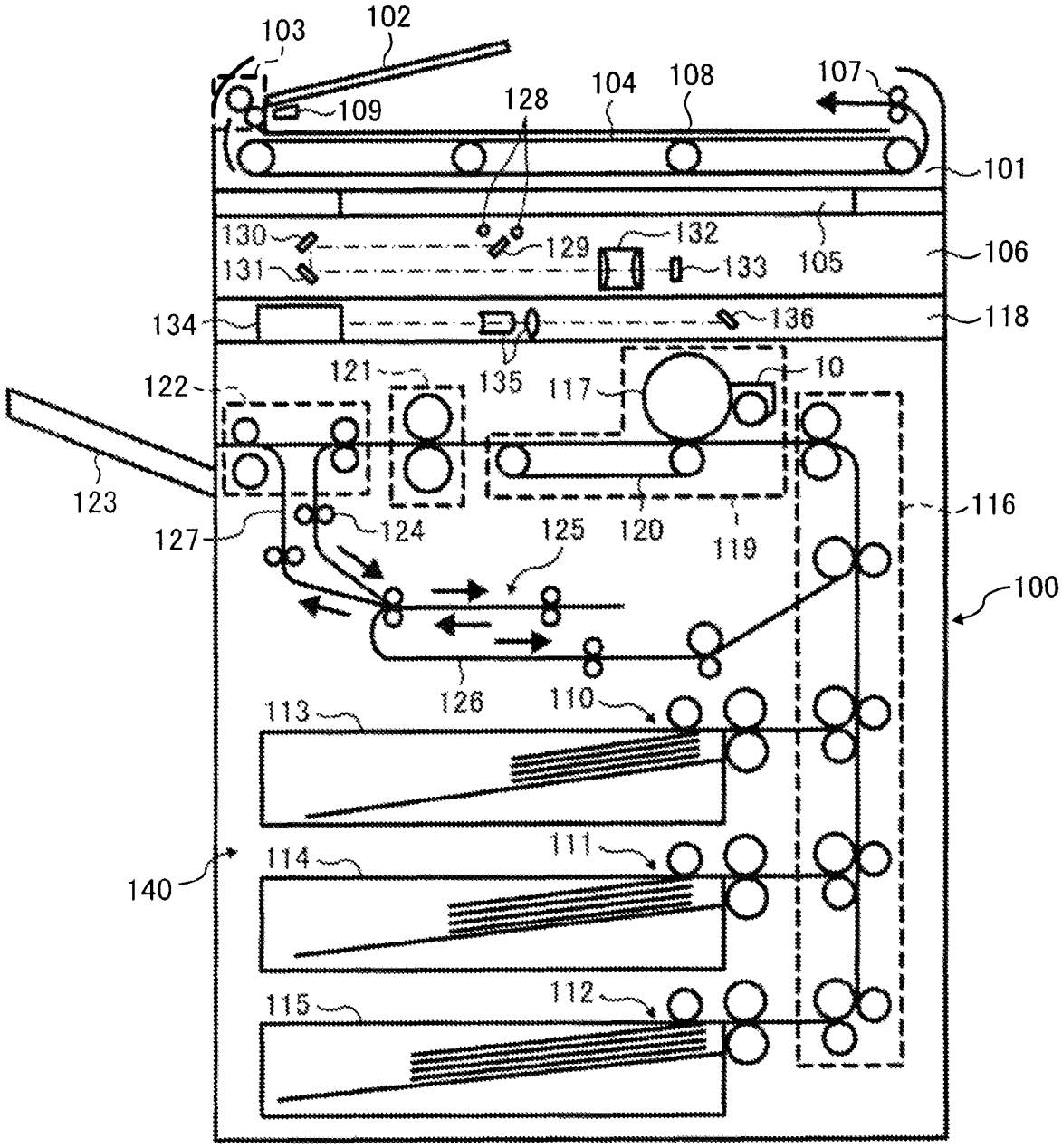
FIG. 14 shows an example of an image forming apparatus to which the present invention can be applied.

As a latent image carrier, a photoconductor 117 shown in FIG. 14 is used in this embodiment.

The development part 10 develops latent images to toner images with two-component developer within the development part 10. As shown in FIG. 2, the development part 10 includes a development roller 12, two conveyor screws 13*a* and 13*b*, and two developer transfer parts 16*a* and 16*b*. The development roller 12 is disposed near the photoconductor 117, bears the developer on its surface by magnetic force, and carries the developer to latent images on the photoconductor for development process. The two conveyer screws 13*a* and 13*b* convey the developer. The two developer transfer parts 16*a* and 16*b* are made from metal, synthetic resin, rubber or the like having a pipe form and connect the development part 10 with the agitation part 50. Two coils 14*a* and 14*b* are disposed inside the developer transfer parts 16*a* and 16*b* respectively, and the ends of the coils 14*a* and 14*b* connect the two conveyer screws 13*a* and 13*b*, respectively, and transfer the developer in response to rotation of the conveyer screws 13*a* and 13*b*.

A toner replenishment part 30 has a shape of pipe and connects the toner container 20 with the agitation part 50. A coil screw 21 is disposed inside the toner replenishment part 30 and rotates in response to rotation of a motor 28. Toner particles are conveyed to the agitation part 50 in response to rotation of the coil screw 21.

As shown in FIG. 3, the agitation part 50 includes a developer injection opening 52 at an upper part, a toner injection opening 57 at the upper part and a developer ejection opening 53 at a lower part. The developer is conveyed into the agitation part 50 through the developer injection opening 52 and ejected from the agitation part 50 through the developer ejection opening 53. Toner particles are conveyed into the agitation part 50 through the toner injection opening 57.

An agitator 54 is disposed approximately perpendicular inside the agitation part 50 and rotates in response to an external motor 58. Rotation of a motor 58 is controlled or adjusted by a controller CON (shown in FIG. 4). The controller CON is connected to the motor 58 and includes CPU, ROM and RAM. The CPU executes a program written in the ROM in order to control the rotation of the agitator 54, and the RAM is used as work area.

The agitator 54 includes a plurality of agitating blades 55 and the developer is agitated inside the agitation part 50 by rotation of the agitating blades 55.

After development process, the developer is retrieved from the development roller 12, conveyed in the direction of arrow C in FIG. 2 by the conveyer screw 13*a*, transferred to the conveyer screw 13*b* through an opening E, conveyed to the direction of arrow D by the conveyer screw 13*b*, and transferred to the agitation part 50 by the coil 14*b*.

The developer is sent through the developer injection opening 52 to the agitation part 50 in which the developer has been contained, and the developer is agitated by the agitator 54. The developer is ejected through the developer ejection opening 53 by gravity, sent back again to the development part 10 by the coil 14*a* and retrieved by the conveyer screw 13*a*.

As toner particles are consumed in the development process, toner density in the developer declines. The toner density is detected by a toner density detector (not shown) and toner particles are sent from the toner container 20, through the toner replenishment part 30, to the agitation part 50 in response to a signal from the toner density detector. Therefore, replenishing consumed toner particles.

The agitator 54 agitates replenished toner particles together with the developer in which the toner density has declined, spreads newly replenished toner particles into the developer, and electrically charges newly replenished toner particles by agitation. However, toner particles and carrier particles which are repeatedly agitated become deteriorated. For example, additive agents on the surface of toner particles are left out or are forced into toner particles and the electric chargeability or the fluidity of toner particles worsens. Regarding carrier particles, a coating layer on the surface of carrier particles is scraped off due to the stress of agitation. Also, the electric chargeability of carrier particles may decline because additive agents or binder resin of toner particles adhere to carrier particles. Therefore, in order to extend the useful life of carrier particles, it is desirable to perform agitation only when necessary.

The developing device develops images with various image area proportions. When an image with a low image area proportion is developed, the amount of consumed toner particles is small and the amount of toner particles to be replenished is small. Thus, the amount of toner particles injected to the agitation part 50 is small, and the agitator 54 does not have to agitate the developer much.

Conversely, when an image with high image area proportion is developed, the amount of consumed toner particles is large and the amount of toner particles injected to the agitation part 50 is large. Therefore, the agitator 54 strengthens the agitation so that the toner particles are spread into the developer and electrically charged with efficiency.

Some measures may be used to strengthen the agitation. For example, the developer can be agitated by increasing a rotation speed of the agitator 54, by rotating for a longer period of time, or by strengthening the rotation torque. Any measure to control the strength of the agitation can be adopted.

In this embodiment, the rotation speed of the agitator 54 can be controlled flexibly by the motor 58. The motor 58 controls rotation speed of the agitator 54 so that the agitator 54 rotates fast when an image with high image area proportion is developed, and slow when an image with low image area proportion is developed. By controlling the rotation of the agitator 54 in response to the amount of replenished toner particles, unnecessary stress on the developer is reduced and, therefore, toner particles are spread and electrically charged more efficiently. If no new toner particles are replenished into the agitation part 50, the agitator 54 does not rotate because the developer is ejected through the developer ejection opening 53 by gravity, not agitation.

Figure 4:
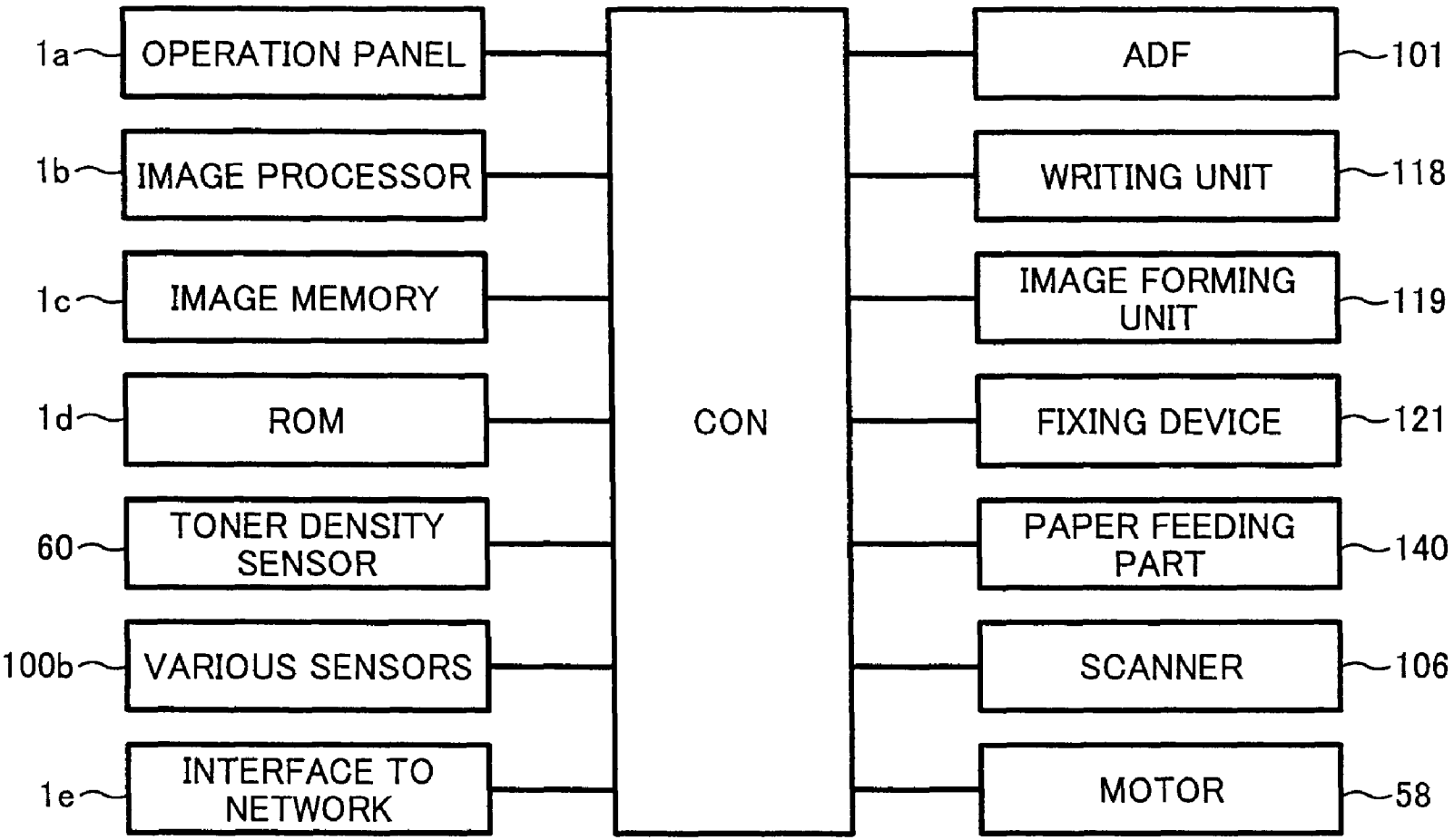
FIG. 4 shows a block diagram of a controller for controlling an image forming apparatus of an embodiment.

As mentioned above, rotation speed of the motor 58 is controlled by the controller CON. FIG. 4 shows a block diagram of a controller for controlling the image forming apparatus shown in FIG. 14. The controller CON controls an auto document feeder (ADF) 101, a writing unit 118, an image forming unit 119, a fixing device 121, a paper feeding part 140, and a scanner 106. An operation panel 1*a*, an image processor 1*b*, an image memory 1*c*, a nonvolatile memory (ROM) 1*d*, a network interface 1*e*, a toner density sensor 60, and various sensors 100*b* are connected to the controller CON. The controller CON operates according to orders that a user inputs in the operation panel 1*a*. Image information is obtained by being scanned by the scanner 106 or by sent from a network by way of the interface to network 1*e*. Thus obtained image information is stored in the image memory 1*c*, and image processing is executed by the image processor 1*b* to the image information stored in the image memory 1*c*. After the image processing, image information is sent to the writing unit 118, and the image forming unit 119 forms a toner image according to the image information radiated from the writing unit 118. The toner image is transferred to a recording medium, such as a paper, that is sent from the paper feeding part 140 and fixed by the fixing device 121. The paper on which the toner image is fixed is ejected from the image forming apparatus, or sent to a reversing part 125.

The program to execute above-explained controls is stored in the nonvolatile memory ROM 1*d* and executed by CPU in the controller CON. Also, the processes that will be explained in the context of the following flowcharts is executed by the CPU in the controller CON.

The amount of replenished toner particles can be obtained from the rotation of the motor 28. Also, the amount of consumed toner particles can be obtained from a number of pixels in a printed image. In this embodiment, the motor 58 is controlled according to the number of pixels in a printed image so that toner particles are injected into the agitation part 50 based on the amount of the consumed toner particles. The motor 58 may also be controlled according to the number of recording mediums printed, or the number of recording mediums printed and the number of pixels printed.

Figure 5:
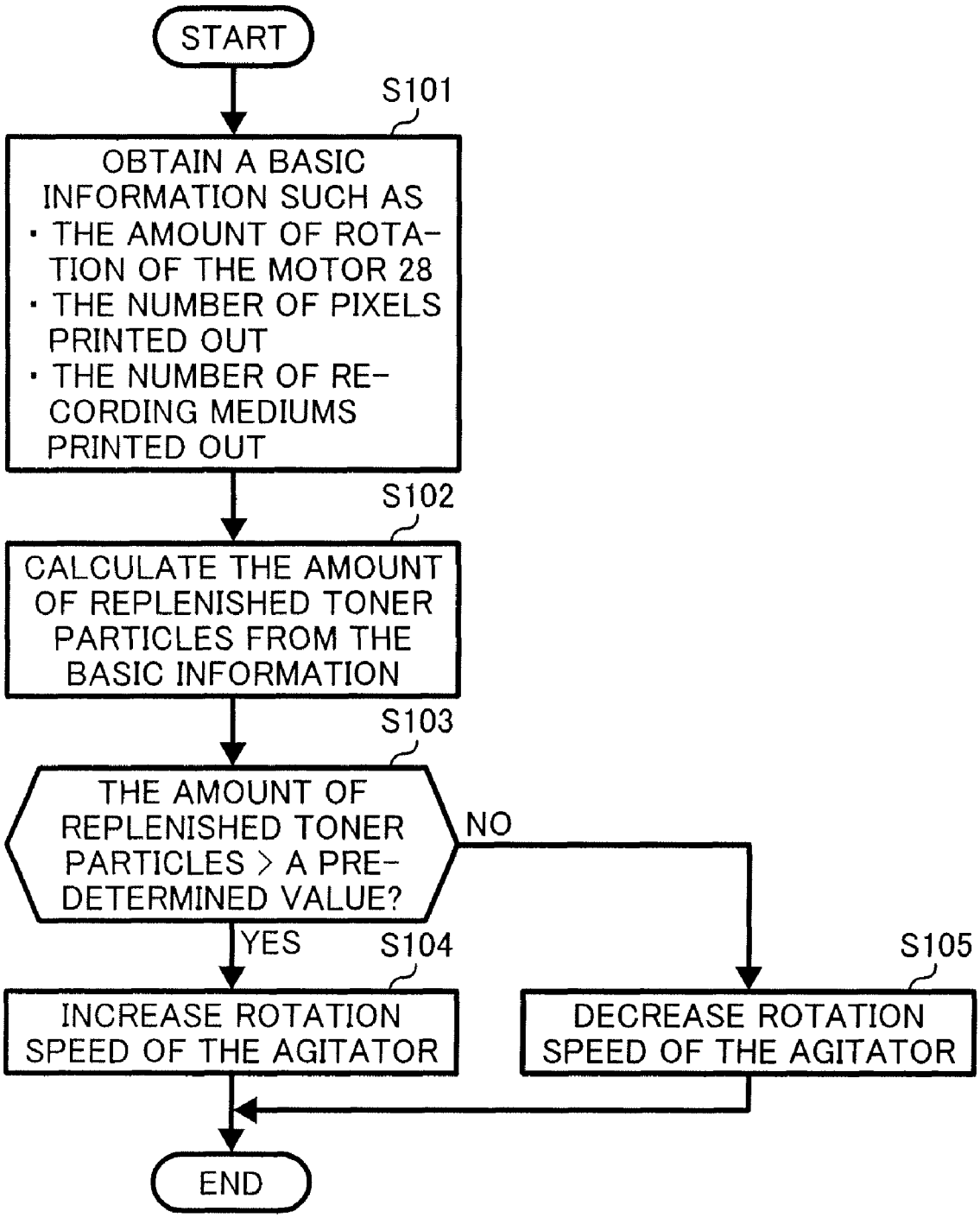
FIG. 5 is a flowchart showing the steps to control the rotation of the agitator.

FIG. 5 is a flowchart showing the steps to control the rotation of the agitator 54. Basic information to calculate the amount of replenished toner particles is obtained at step S101. The basic information in this embodiment is one of the amount of rotation of the motor 28, the number of pixels printed, or the number of recording mediums printed. Then, the amount of replenished toner particles is calculated from the basic information at step S102. Whether the amount of replenished toner particles is larger than a predetermined value is judged at step S103. The predetermined value represents a proper amount of toner particles to be replenished corresponding to current rotation speed, and this value is obtained in advance and stored in the ROM 1*d*. Based on the result of step S103, the rotation speed of the agitator 54 is increased at step S104 if the amount of replenished toner particles is larger than a predetermined value. Alternatively, the rotation speed of the agitator 54 is decreased at step S105 if the amount of replenished toner particles is smaller than the predetermined value.

Figure 6:
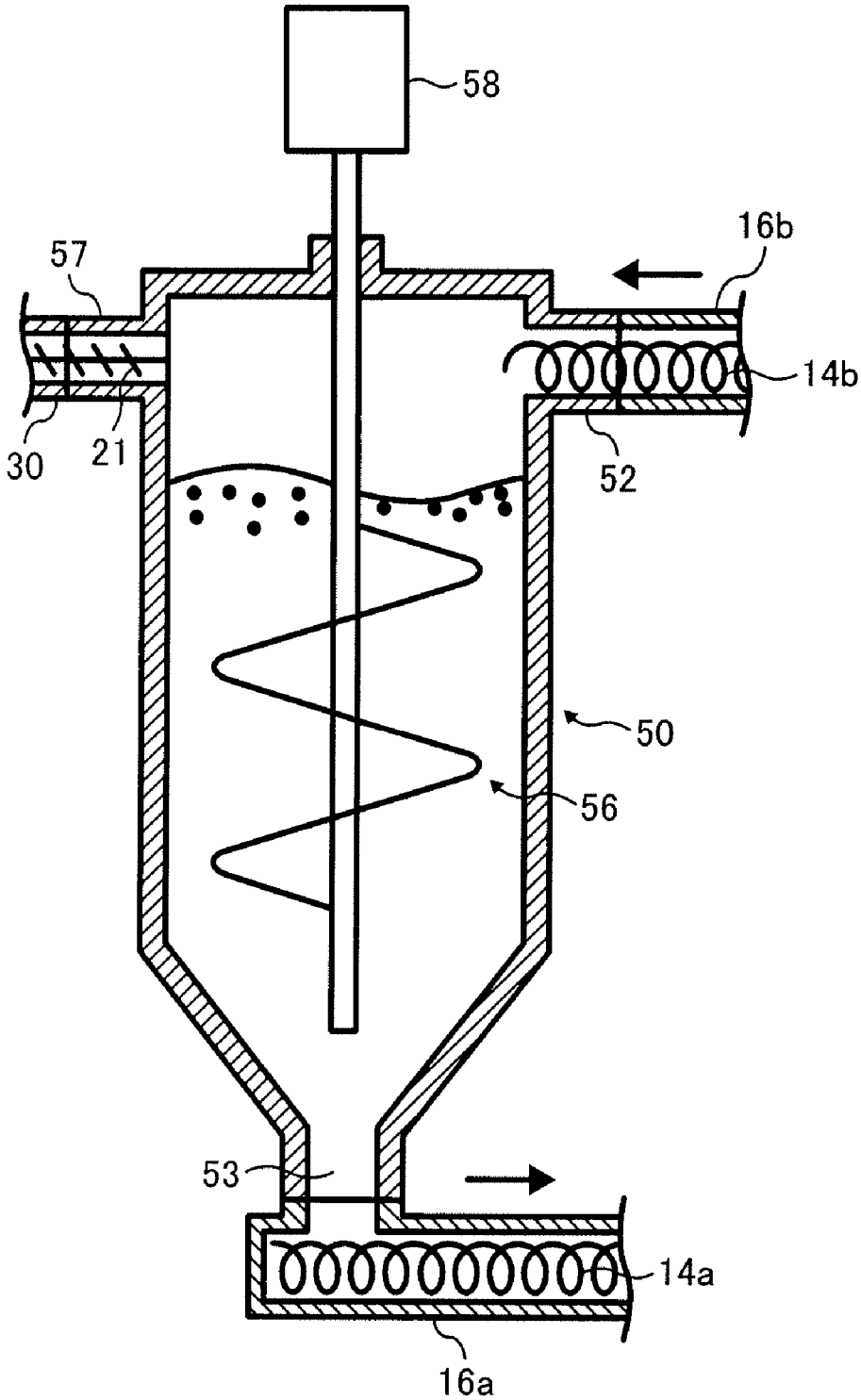
FIG. 6 is a longitudinal sectional view of another example of agitation part.

FIG. 6 shows a cross section of another type of agitator. A screw 56 is used as an agitator in the agitation part 50, and by the rotation of the screw 56, the developer is moved upwards. Other elements in FIG. 6 work the same way as elements indicated by the same index numbers in FIG. 3. In the agitation part 50, the developer moving downward by gravity and the developer moving upward by the rotation of the screw 56 make contact, causing the toner particles to be electrically charged. The rotation speed of the screw 56 can be controlled, and the faster the rotation speed of the screw 56 is, the faster toner particles can be electrically charged.

By controlling the agitation in the agitation part 50, toner particles can be spread in the developer and electrically charged effectively, thus extending the lifetime of the developer. However, as time goes by, the developer deteriorates and electrical chargeability of carrier particles declines. Therefore, to improve the decline of the electrical chargeability of carrier particles, it is preferable to change the rotation condition so that the developer is agitated more as the cumulative number of printed image increases.

Figure 7:
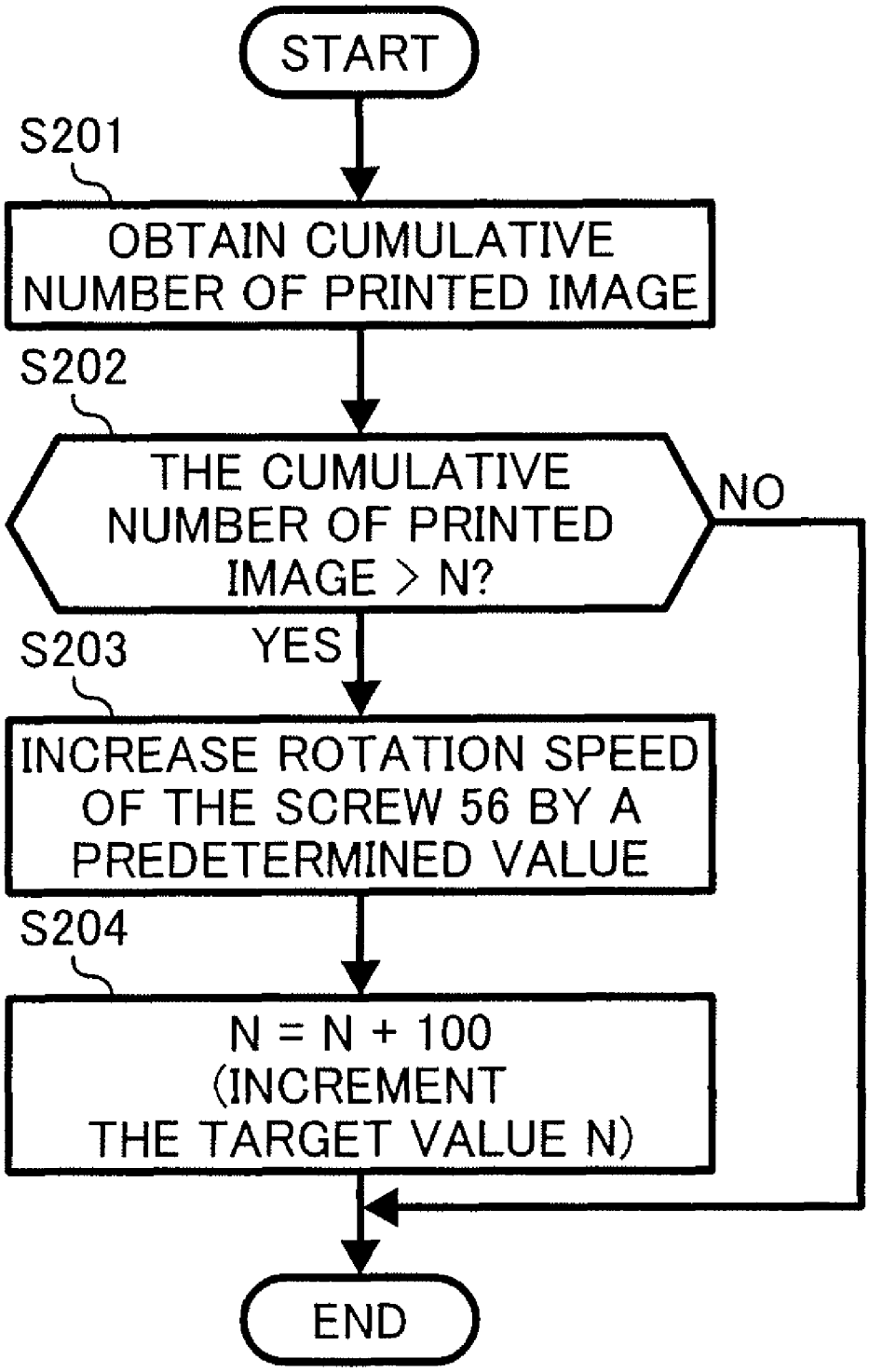
FIG. 7 is a flowchart showing the steps to control the rotation of the screw.

FIG. 7 is a flowchart showing the steps to control the rotation of the screw 56. The cumulative number of printed image is obtained at step S201 and compared with a value N at step S202. If the cumulative number of printed image is greater than N, the rotation speed of the screw 56 is increased at step S203. The amount of increase is a predetermined value designed to correspond to the drop of the electrical chargeability. The value N is incremented by adding a predetermined value at step S204 (for example, one hundred in this embodiment) and the process is done. If, however, the cumulative number of printed images is equal to or smaller than N in step S202, the rotation speed of the screw 56 is unchanged. Thus, compensating for the decline of the electrical chargeability of the carrier particles.

Figure 8:
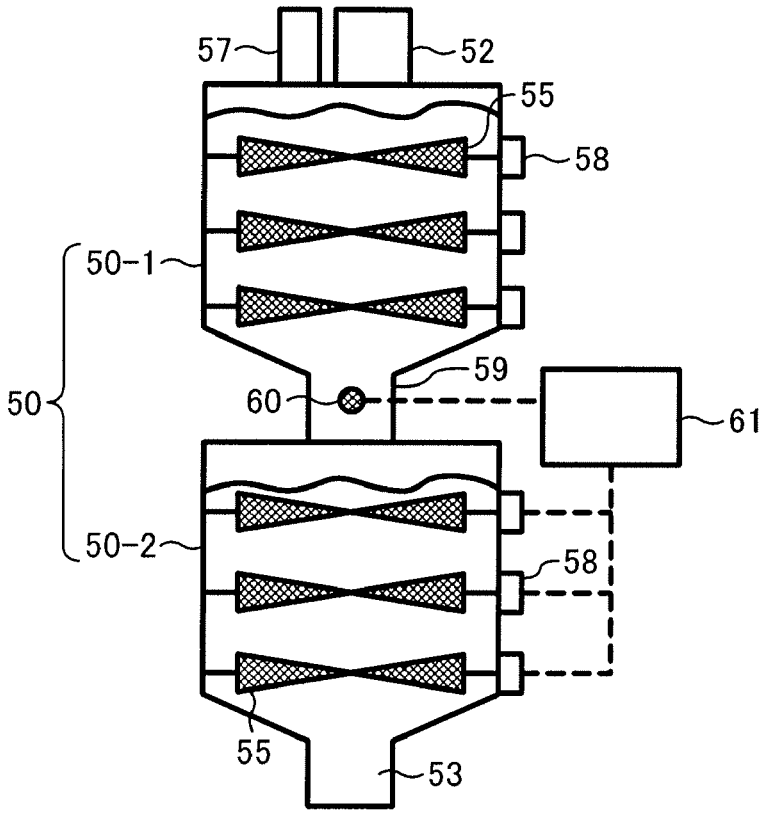
FIG. 8 is a longitudinal sectional view of an agitation part of another embodiment.

FIG. 8 shows another embodiment of a developing device of the present invention. In this embodiment, the agitation part 50 includes two agitation sections 50-1 and 50-2. In each of two agitation sections 50-1 and 50-2, agitator blades 55 are disposed, which rotate independently in response to the rotation of motor 58. Toner particles are agitated and mixed with the developer by rotation of each agitator blade 55.

The developer and toner particles are injected from a developer injection opening 52 at the upper part of the agitation part 50 and a toner injection opening 57 at the upper part of the agitation part 50, respectively. The injected developer and toner particles move downward by gravity, and are ejected from a developer ejection opening 53 at a lower part. During transfer from the upper part to the lower part, the developer and toner particles can be agitated by the agitator blades 55 or, when the agitator blades 55 are not operational, move downward without agitation. The form of the agitator blades 55 can be propeller shape or ribbon shape or the like. The rotation speed of the agitator blades 55 can be changed according to the amount of replenished toner particles or according to an image area proportion of an image. If the image area proportion is high and the amount of replenished toner particles is large, the agitator blade 55 rotates fast. If the image area proportion is low and the amount of replenished toner particles is small, the agitator blade 55 rotates slowly.

Figure 9A:
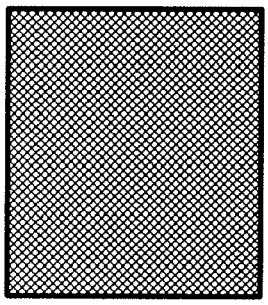
FIGS. 9A and 9B show examples of image information.
Figure 9B:
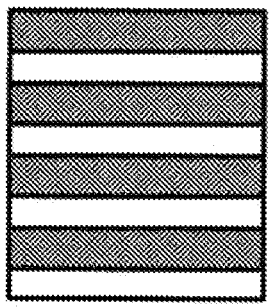

The fluctuation of toner density in the developer after development is large. For example, as shown in FIGS. 9A and 9B, a mesh image shown in FIG. 9A has the same image area proportion as a stripe image shown in FIG.9B. However, the toner density varies larger when the stripe image shown in FIG. 9B is developed than when the mesh image shown in FIG. 9A is developed. Therefore, when the stripe image shown in FIG. 9B is developed, it is desirable to impart more agitation to uniformly mix toner particles with the developer. Thus, it is preferable to change the rotation condition in response to fluctuation of toner density in the developer.

However, even if the rotation of the agitator is controlled so that the rotation condition is changed in response to the fluctuation of toner density in the developer, it is difficult to mix toner particles in the developer efficiently. If many toner particles are replenished, toner particles flow in the air inside the agitation part 50 and do not mix with the developer quickly. Also, it is difficult to mix toner particles with the developer effectively under continuous replenishment. Therefore, in this embodiment, the two agitation sections 50-1 and 50-2 are disposed in the agitation part 50 and the lower agitation section 50-2 agitates toner particles without being replenished. Each of the two agitation sections 50-1 and 50-2 can be controlled independently. It is also effective to dispose three or more agitation sections and control them independently.

The motion of this the agitation part 50 will be described below.

After a development process resulting in a large fluctuation of toner density, toner particles are sent to the agitation section 50-1 to recover the toner density in the developer. The agitation section 50-1 agitates the developer after the development process and replenishes toner particles to make the toner density in the developer somewhat uniform. The agitation section 50-2 receives the developer coming from the agitation section 50-1, and agitates the developer according to the fluctuation in the toner density. Since new toner particles are not replenished into the agitation section 50-2, agitating the developer according to the fluctuation in the toner density makes the developer sufficiently uniform in toner density.

The detail of the control to agitate the developer according to the fluctuation in the toner density will be described.

A toner density sensor 60 is disposed at the link part 59 between the agitation section 50-1 and 50-2. The toner density sensor 60 detects the toner density in the developer moving near the toner density sensor 60, and the detected toner density is sent to, and recorded, by a toner density adjuster 61. The toner density adjuster 61 estimates the amount of fluctuation in toner density "dTC" from the continuous data of the toner density and adjusts the rotation speed of the agitator blades 55 in the agitation section 50-2 by controlling the motor 58 according to the detected fluctuation in the toner density.

The value dTC is calculated as the difference between the maximum value and the minimum value of the toner density over a certain time in this embodiment. It is also possible to use variance, standard deviation or the like as dTC.

The toner density adjuster 61 can be a part of the controller CON or can be a circuit independent from the controller CON.

Figure 10:
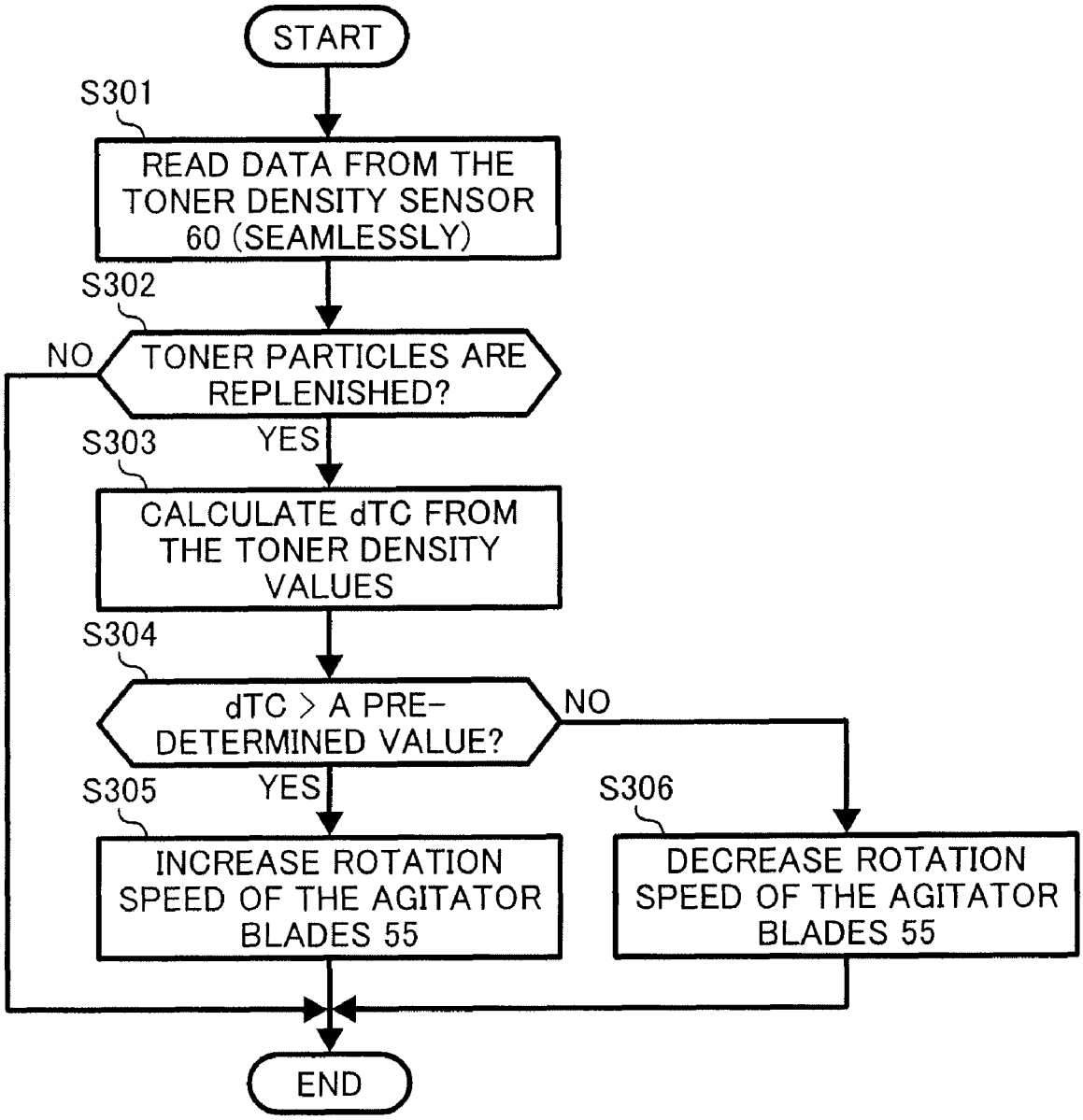
FIG. 10 is a flowchart showing steps to control the agitation.

FIG. 10 is a flowchart showing steps to control the agitation. Data from the toner density sensor 60 is sent to, and recorded by, the toner density adjuster 61 at step S301. The toner density adjuster 61 judges whether toner particles are replenished at step S302. When toner particles are replenished, the result at step S302 becomes "YES" and the toner density adjuster 61 calculates dTC from the toner density values at step S303. The toner density adjuster 61 judges whether dTC is larger than a predetermined value at step S304. The predetermined value represents a proper amount of dTC corresponding to current rotation speed, and is obtained in advance and stored in the ROM 1*d*.

If dTC is judged to be larger than the predetermined value, rotation speed of the agitator blades 55 is increased at step S305. If dTC is judged to be equal to or smaller than the predetermined value, rotation speed of the agitator blades 55 is decreased at step S306. Thus, the fluctuation in toner density is sufficiently suppressed.

Therefore the agitation section 50-2 agitates the developer according to the fluctuation in the toner density. As a result, toner particles can be mixed with the developer effectively and the electrical chargeability of toner particles can be stabilized.

By separating the agitation part from the development part, stress on toner particles and carrier particles is reduced. However, over time, repeatedly agitated toner particles and carrier particles still deteriorate. For example, additive agents on the surface of toner particles are left out or are forced into toner particles, and the electric chargeability or the fluidity of toner particles suffers. As for carrier particles, a coating layer on the surface of carrier particles is still scraped off and the electric chargeability of carrier particles may still decline because additive agents or binder resin of toner particles adhere to carrier particles over time. Therefore, it is preferable to agitate the developer only when toner particles are replenished to reduce stress on the developer.

Figure 11:
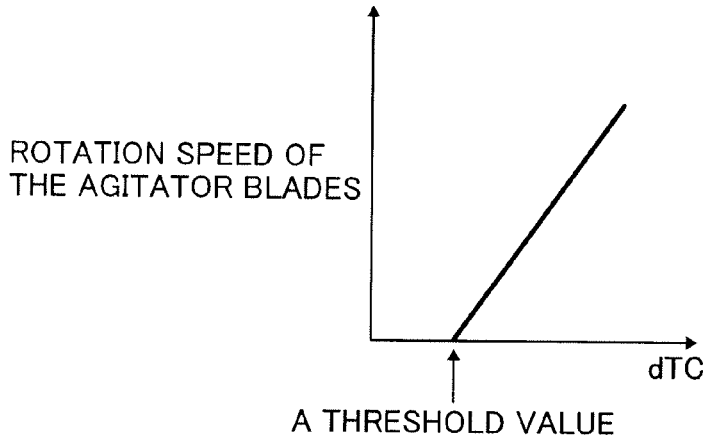
FIG. 11 shows a graph indicating relationship between the rotation speed of the agitator (vertical axis) and the amount of fluctuation in toner density dTC (horizontal axis)

FIG. 11 shows a graph indicating relationship between the suitable rotation speed of the agitator blades 55 in the agitation section 50-2 (vertical axis) and the amount of fluctuation in toner density dTC (horizontal axis). As described above, in this embodiment, the toner density adjuster 61 decreases the rotation speed of the motor 58 if dTC is small.

In this embodiment, if dTC is smaller than a predetermined value, the toner density adjuster 61 stops the rotation of the agitator blades 55 in the agitation section 50-2. This control decreases stress and reduces deterioration of the developer.

Since the developer and toner particles are injected into upper part and ejected from lower part of the agitation part 50, toner particles are not mixed well with the developer at the upper part and are mixed relatively well with the developer at the lower part.

In this embodiment, each agitator blade 55 in the agitation sections 50-1 and 50-2 is connected to its own motor 58 and can be rotated independently. It is preferable to control the agitator blade 55 so that the agitator blade at upper part of the agitation part 50 is rotated faster than the agitator blade at lower part. The control makes it possible to agitate the developer according to the position of the developer in the agitation part 50 and to mix the developer effectively according to the mixing condition of the developer.

Figure 12:
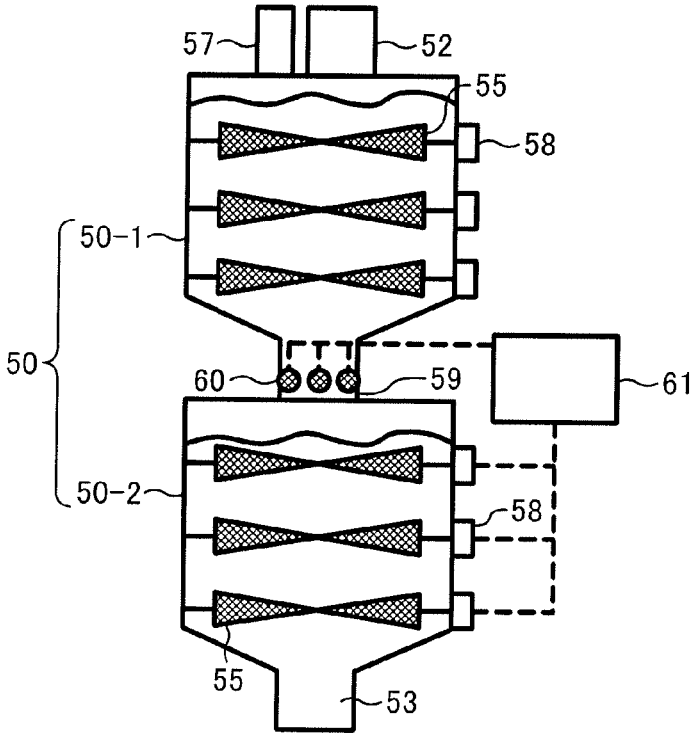
FIG. 12 shows an example of the toner density sensor.

FIG. 12 shows another example of the toner density sensor 60. In this example, more than one of toner density sensors are disposed to detect the toner density. Three sensors are disposed at the link part between the agitation sections 50-1 and 50-2. Each sensor is disposed adequately separate from each other, and the plural sensor cover a wider area to detect the toner density more accurately and efficiently. Other elements in FIG. 12 work the same way as elements indicated by the same index numbers in FIG. 8.

Each toner density sensor 60 outputs a voltage value representing the toner density according to the magnetic strength of the developer nearby. The output value of the toner density sensor is large if the proportion of magnetic carrier particles in the developer becomes large.

Figure 13:
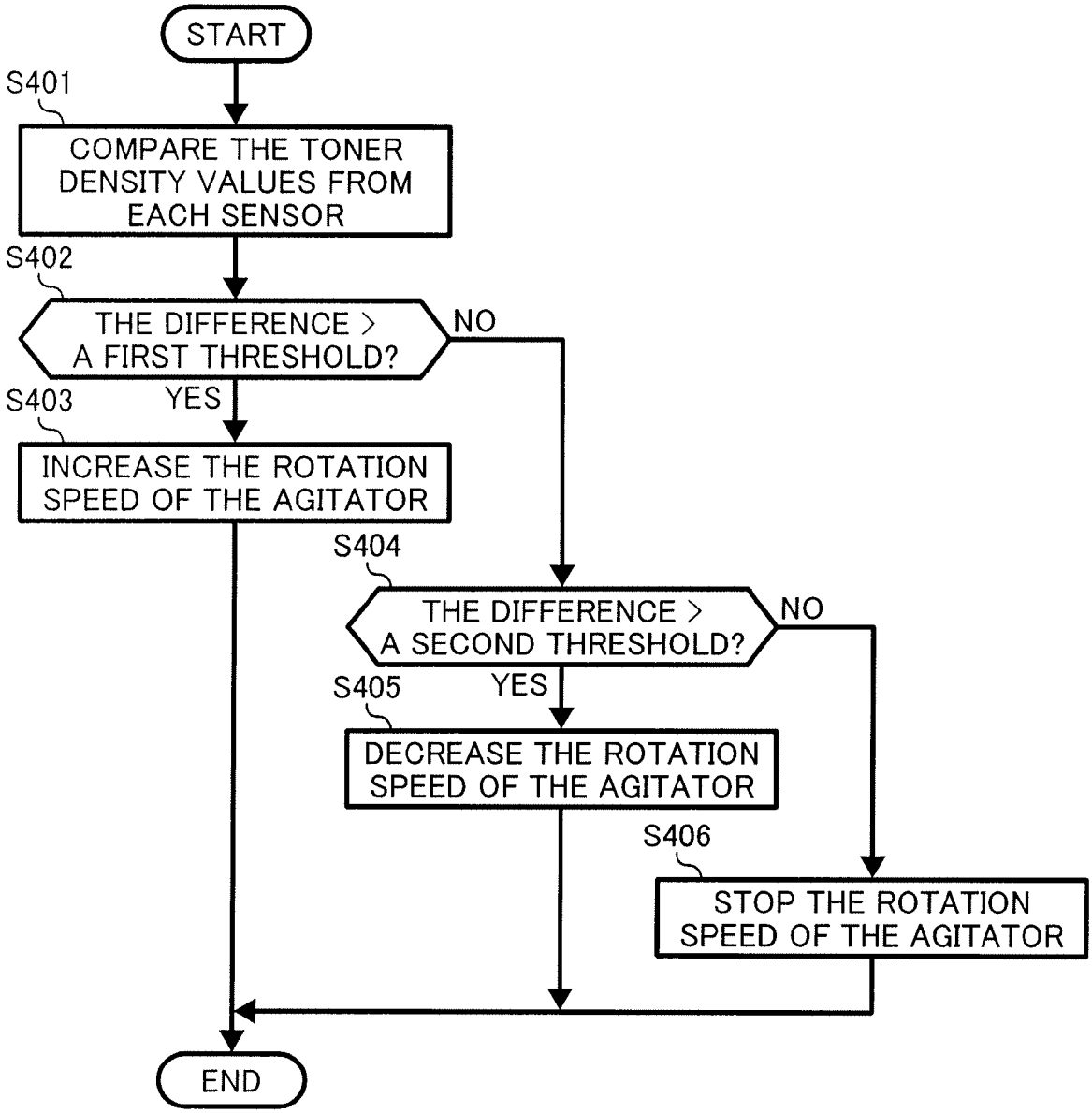
FIG. 13 is a flowchart showing the steps to control the rotation of the motor.

The toner density values detected by each toner density sensor 60 are sent to the toner density adjuster 61, which controls the rotation of the motor 58 according to steps shown in FIG. 13, and explained below.

The toner density adjuster 61 compares the toner density values from each sensor at step S401 and judges whether the difference between the toner density values from each sensor is larger than a first threshold at step S402. If the toner density adjuster 61 judges the difference is larger than the first threshold, the motor 58 is controlled to increase the rotation speed of the agitator at step S403.

Various values can be used as "the difference between the toner density values from each sensor" as long as the value represents the fluctuation between detected values. In this embodiment, the difference between the maximum value and the minimum value is used as "the difference between the toner density values from each sensor." But it is also possible to use variance, standard deviation or the like.

In the following explanation about FIG. 13, and in FIG. 13, "the difference between the toner density values from each sensor" is expressed as "the difference."

If the toner density adjuster 61 judges the difference is equal to or smaller than the first threshold, the toner density adjuster 61 further checks whether the difference is larger than a second threshold as step S404. If the difference is larger than the second threshold, the motor 58 is controlled to decrease the rotation speed of the agitator at step S405. If the difference is equal to or smaller than the second threshold, the toner density adjuster 61 controls the motor 58 to stop at step S406 because the toner density is estimated to be efficiently uniform.

As shown in this example, even when there is a fluctuation in the toner density within the same height, the fluctuation can be detected by plural toner density sensors 60, and the developer can be agitated more effectively in response to the fluctuation. The more sensors that are provided, the more toner density data are taken and the more accurate control is executed.

According to the investigation executed by inventors of the present invention, if the fluctuation of the toner density dTC in the developer is equal to or less than 0.1% by weight, toner scattering or toner adhesion to the non-image area is sufficiently suppressed during the development process. Therefore, it is possible to stop agitating if the value of dTC is smaller than 0.1% by weight. Here, the unit "% by weight" is defined as weight of toner particles divided by weight of the developer. The relation between the output signal from each toner density sensor 60 and the toner density value expressed by the unit of "% by weight" is stored as a table in ROM 1*d*. The toner density adjuster 61 converts output signals from the toner density sensors 60 to the toner density values, and checks whether dTC is greater than 0.1% by weight.

As for a color image forming apparatus, toner particles have a slightly different tendency of being mixed with the developer or being electrically charged, depending on the color of toner particles such as, for example, cyan, magenta, yellow and black. Therefore, it is preferable to set a threshold value suitable for each color toner particles. If toner particles are not sufficiently charged, it is preferable to reduce the threshold value so that toner particles can be further agitated.

As shown above, by controlling the strength of agitation in the agitation part separate from the development part, the proportion of toner particles in the developer is stabilized and stress on the developer is reduced.

FIG. 14 shows an example of an image forming apparatus to which the present invention can be applied. The image forming apparatus is a multifunctional machine that can be used as not only a copier but also as a printer, fax and the like. Each application can be selected by operating an operation panel (not shown) of the image forming apparatus. If a copier application is selected, the image forming apparatus works as a copier, if a printer application is selected, the image forming apparatus works as a printer and if a fax application is selected, the image forming apparatus works as a fax.

This image forming apparatus is a black-white color image forming apparatus and basically includes a main body 100, a writing unit 118 disposed above the main body, a scanner 106 disposed above the writing unit and an ADF 101.

As a copier, the image forming apparatus operates as follows:

1. Original documents are put on a document tray 102 of ADF 101 with images on upper face of the documents.

2. When a start button on the operation panel is pushed, a feed roller 103 and a feed belt 104 send a lowest document to a predetermined position on a contact glass 105 as a document stage. ADF 101 includes a counter that counts up every document fed to the contact glass 105.

3. After the image information of the document on the contact glass 105 is read by the scanner 106, the feed belt 104 and an eject roller 107 send the document to a eject tray 108. The feed roller 103, the eject roller 107 and the feed belt 104 are driven by motors (not shown).

4. If a document detector 109 detects a next document on the document tray 102, a lowest document is sent to the predetermined position on the contact glass 105 by the feed roller 103 and the feed belt 104 just like the preceding document.

The scanner 106 reads an image on a document as follows:

1. Two lamps 128 scan a document on the contact glass 105 while radiating light to the document.

2. The reflection from the document is reflected by a first mirror 129, a second mirror 130 and a third mirror 131, and led to a CCD sensor (a photoelectric transformation device) 133 through a focus lens unit 132.

The image information read by the scanner 106 is processed by an image processor (not shown), radiated from the writing unit 118 to the photoconductor (a latent image carrier) 117 and written on the photoconductor 117 as a latent image. The writing unit 118 includes a laser beam emitting device 134, an fθ lens 135, and a reflective mirror 136. Another light source such as a light emitting diode can be used instead of the laser beam emitting device 134.

The main body 100 includes the photoconductor 117, the development part 10, the fixing device 121, a paper eject part 122, paper feed devices 110, 111 and 112, a vertical paper convey part 116 and so on.

The photoconductor 117 is electrically charged by a charger (not shown) and radiated by light from the writing unit 118 and a latent image is formed on the photoconductor 117. The latent image on the photoconductor 117 is developed by the development part 10 to a toner image.

The photoconductor 117, the development part 10, the charger, a conveyer belt 120, a cleaning part (not shown) and discharge part form the image forming unit 119. And paper feed elements including a vertical paper convey part 116, a reversing part 125 and paper feed devices 110,111 and 112 form the paper feeding part 140.

The conveyer belt 120 is disposed below the photoconductor 117. The conveyer belt 120 works as a conveyer of recording mediums, such as paper, and works as a transfer device. The conveyer belt 120 conveys a paper from the vertical paper convey part 116 at the same speed as the peripheral speed of the photoconductor 117 and transfers the toner image from the surface of the photoconductor 117 to the paper by the electric bias. The electric bias is served by imposing a voltage on the conveyer belt 120 from a battery (not shown).

The toner image transferred on the paper is then fixed to the paper by the fixing device 121 and ejected to an eject tray 123 by the paper eject part 122.

The surface of the photoconductor is cleaned up by the cleaning part. The photoconductor 117, the charger, the writing unit 118, the development part 10 and the transfer device are considered as an image forming unit which forms toner images on papers according to image information. The photoconductor 117 rotates at a fixed speed and is driven by a main motor.

The paper eject part 122 further includes a double-face recording path in this embodiment. A paper can be sent to a reversing part 125 by a pair of rollers 124, reversed upside down by the reversing part 125. The reversed paper can be transferred again to the vertical paper convey part 116 through a conveying path 126 for double-face recording, or, the reversed paper can be transferred to the paper eject part 122 through a conveying path 127 and ejected upside down. Thus, a paper holding toner images on one face can be transferred to the image forming unit again for double-face recording, or can be ejected holding toner images at the lower face of a paper.

The first paper feed device 110, the second paper feed device 111 and the third paper feed device 112 feeds a paper from a first tray 113, a second tray 114 and a third tray 115, respectively. The paper fed from the paper feed devices is sent to the vertical paper convey part 116 and then sent toward the photoconductor 117 by the vertical paper convey part 116.

When the image forming apparatus is used as a printer, the image information is sent to the writing unit 118 from outside of the apparatus instead of from the image processor.

When the image forming apparatus is used as a fax, the image information scanned by the scanner 106 is sent to a receiver by a communication part (not shown) and the received image information is sent to the writing unit 118 from the communication part instead of from the image processor.

The image information sent to the writing unit 118 is transformed to toner images by the same procedure of a copier.

According to the present invention, as the electrical charge amount of toner particles can be controlled according to the amount of replenished toner particles by controlling the strength of the agitation of the agitator, toner particles can be electrically charged and spread properly without imposing excessive stress on the developer.

What is claimed is:

1. A developing device, comprising:

a development part configured to develop a latent image to a toner image, the development part including a development roller and a conveyor configured to convey developer, the developer comprising toner particles and carrier particles;

an agitation part provided separately from the development part and configured to agitate the developer and receive replenished toner particles; and a controller configured to increase an agitation strength of the agitation part when an amount of replenished toner particles received by the agitation part is greater than a predetermined threshold value, and decrease the strength of the agitation part when an amount of replenished toner particles received by the agitation part is less than the predetermined threshold value, wherein the agitation part includes a toner injection opening through which toner injection opening the agitation part receives toner;

a developer injection opening, separate from the toner injection opening, through which developer injection opening the agitation part receives developer from the development part; and a developer ejection opening through which developer ejection opening the agitation part discharges developer comprising a mixture of toner received through the toner injection opening and developer received through the developer injection opening.

2. The developing device according to claim 1, wherein:

the controller is configured to control the agitation strength of the agitator according to an image area proportion of a printed image.

3. The developing device according to claim 1, wherein:

the agitation part is configured to rotate; and the controller is configured to control the agitation strength of the agitation part by controlling a rotation speed of the agitation part.

4. The developing device according to claim 1, wherein:

the agitation part comprises a screw configured to convey the developer away from an ejecting portion of the agitation part by rotating; and the controller controls the agitation strength of the agitation part by controlling a rotation speed of the screw.

5. The developing device according to claim 1, wherein:

the agitation part comprises a plurality of agitation sections; and the controller is configured to control each agitation section independently.

6. The developing device according to claim 1, wherein:

the agitation part comprises at least one toner density sensor configured to detect a fluctuation in toner density in the agitation part; and the controller is configured to control the agitation strength of the agitation part according to a detected fluctuation in toner density.

7. The developing device according to claim 6, wherein:

the agitation part comprises a plurality of toner density sensors.

8. The developing device according to claim 6, wherein:

the agitation part comprises a plurality of agitation sections; and the controller is configured to stop agitating the developer in one of the plurality of agitation sections, when the fluctuation of the toner density is smaller than a threshold value.

9. The developing device according to claim 8, wherein the threshold value is 0.1% by weight.

10. The developing device according to claim 8, wherein the threshold value is determined according to a color of toner in the developer.

11. The developing device according to claim 1, wherein the toner injection opening and developer injection opening are disposed above the developer ejection opening.

12. An image forming apparatus, comprising:

a latent image carrier;

a development part configured to develop a latent image on the latent image carrier to a toner image, the development part including a development roller and a conveyor configured to convey developer, the developer comprising toner particles and carrier particles;

a transfer device configured to transfer the toner image from the latent image carrier to a recording medium;

a fixing device configured to fix the toner image to the recording medium;

an agitation part provided separately from the development part and configured to agitate the developer and receive replenished toner particles; and a controller configured to increase an agitation strength of the agitation part when an amount of replenished toner particles received by the agitation part is greater than a predetermined threshold value, and decrease the strength of the agitation part when an amount of replenished toner particles received by the agitation part is less than the predetermined threshold value, wherein the agitation part includes a toner injection opening through which toner injection opening the agitation part receives toner;

a developer injection opening, separate from the toner injection opening, through which developer injection opening the agitation part receives developer from the development part; and a developer ejection opening through which developer ejection opening the agitation part discharges developer comprising a mixture of toner received through the toner injection opening and developer received through the developer injection opening.

13. The image forming apparatus according to claim 12, wherein the toner injection opening and developer injection opening are disposed above the developer ejection opening.

* * * * *